US007429626B2

(12) United States Patent
Zucker

(10) Patent No.: US 7,429,626 B2
(45) Date of Patent: Sep. 30, 2008

(54) ABLATIVE COMPOUNDS

(75) Inventor: Jerry Zucker, Charleston, SC (US)

(73) Assignee: PBI Performance Products, Inc., Charlotte, NC (US)

( * ) Notice: Subject to any disclaimer, the term of this patent is extended or adjusted under 35 U.S.C. 154(b) by 0 days.

(21) Appl. No.: 11/705,936

(22) Filed: Feb. 13, 2007

(65) Prior Publication Data

US 2007/0186487 A1 Aug. 16, 2007

Related U.S. Application Data

(60) Provisional application No. 60/773,703, filed on Feb. 15, 2006.

(51) Int. Cl.
*C09K 3/14* (2006.01)

(52) U.S. Cl. ..... 524/400

(58) Field of Classification Search ..... 524/400
See application file for complete search history.

(56) References Cited

U.S. PATENT DOCUMENTS 4,001,475 A 1/1977 Chambers et al.
4,732,804 A 3/1988 Kujas
5,212,944 A 5/1993 Martin et al.
5,434,210 A * 7/1995 Rangaswamy et al. ..... 524/406
5,703,178 A 12/1997 Gasmena
5,821,284 A 10/1998 Graham et al.
6,265,330 B1 7/2001 Pennington et al.
6,566,420 B1 5/2003 Guillot et al.
6,933,334 B2 8/2005 Cosby et al.
6,953,823 B2 10/2005 Fan

FOREIGN PATENT DOCUMENTS

WO WO 2006/012581 A2 2/2006

OTHER PUBLICATIONS

Joseph H. Koo, "Polymer Nanostructured Materials for High-Temperature Applications: Fabrication, Characterization & Performance," Presentation, The FAMU-FSU College of Engineering (Tallahassee, FL), (Mar. 23, 2004).

* cited by examiner

*Primary Examiner*—Kriellion A Sanders
(74) *Attorney, Agent, or Firm*—Hammer & Associates, P.C.

(57) ABSTRACT

An ablative compound is made with a synthetic perovskite having an aspect ratio greater than 100.

4 Claims, No Drawings

ABLATIVE COMPOUNDS

RELATED APPLICATION

The instant application claims the benefit of U.S. Provisional Patent Application Ser. No. 60/773,703 filed Feb. 15, 2006, pending.

BACKGROUND OF THE INVENTION

Ablative compounds are designed to protect an article from a heat source (usually a source of extreme heat) by being coated on the article and being burned away while exposed to that heat source. The ablative compound is sacrificed to protect the article.

For example, in solid fuel rocket engines, the solid fuel is contained within a body (usually a closed tube with a nozzle, the tube being made of metal or composite material). Between the solid fuel and the body is an ablative compound. The ablative compound protects the shell from the heat generated during the solid fuel burn. The ablative compound sheds layers as it is burned off, increasing the time it takes the heat to reach the body. Typically, the protection needs to last no more than a few minutes. If there was no ablative compound, the heat of the burning solid fuel would likely burst the shell.

Such ablative compounds, typically, are rubber based. Rubbers include natural and synthetic rubbers. Synthetic rubbers include: EPDM, EPM, nitrile, etc. These compounds are filled with various natural and synthetic materials (fibers and particulates). These fillers include asbestos, mica. Examples of ablative compounds and their components may be found in the following representative, but not exhaustive, list of U.S. Pat. Nos.: 6,953,823; 6,933,334; 6,566,420; 6,265,330; 5,821,284; 5,703,178; 5,212,944; 4,732,804; 4,001,475, which are incorporated herein by reference.

The use of nanoparticles in ablative compounds for rocket engines is known. See: J. H. Koo, *Polymer Nanostructured Materials for High-Temperature Applications: Fabrication, Characterization & Performance*, Presentation at The FAMU-FSU College of Engineering, Tallahasse, Fla., Mar. 23-24, 2004 (jkoo@mail.utexas.edu). The nanoparticles discussed in this presentation were limited to: montmorillonite clays, carbon nanofibers, polyhedral oligomeric silsesquioxanes, carbon nanotubes, nanosilica, others ($TiO_2$, $Al_2O_3$, etc.). Ibid., page 9.

Accordingly, there is a need for new ablative compounds that have greater high temperature performance capabilities at lesser weights.

SUMMARY OF THE INVENTION

An ablative compound is made with a synthetic perovskite having an aspect ratio greater than 100.

DESCRIPTION OF THE INVENTION

It is postulated that the use of synthetic perovskite (such as those disclosed in WO 2006/012581 published Feb. 2, 2006 and University of South Carolina Disclosure USCRF #00600, entitled "Layered Perovsite Materials in High-Temperature Sacrificial Insulating Applications" by Dr. Hans-Conrad zur Loye, both of which are incorporated herein by reference) with aspect ratios of greater than 100 and alternatively, from 100-700 at 15-30 angstroms in ablative compounds, would significantly improve the ablative properties of the compound. For example, the quantity of ablative compound or the thickness of the ablative compound on the body may be reduced while maintaining the ablative protection (e.g., the unit quantity of ablative containing the perovskite per the unit of propellant may be lowered when compared to prior art ablatives). It is believed that the blends of the polymer and perovskite will produce materials having intermittent layers (e.g., ablative compound (ac)/perovskite (p)/ac/p . . . ) and very low coefficients of thermal conductivity.

Surprisingly, it has been determined that perovskite blend very well into polymer systems. 'Very well' means that during mastication (mixing) the addition of the perovskite does not 'dry out' the compound (e.g., does not cause the compound to be crumbly or flaky, but instead remains a coherent mass) and this comparison is made relative to other minerals (e.g., mica but excluding asbestos). The consequence of this unique ability to blend is that higher loading rate may be achieved. Loading rates of 30-40% by weight of the compound are easily achieved and it is expected that greater loading rates are possible.

The present invention may be embodied in other forms without departing from the spirit and the essential attributes thereof, and, accordingly, reference should be made to the appended claims, rather than to the foregoing specification, as indicated the scope of the invention.

I claim:

1. In an ablative compound, the improvement comprising the use of synthetic perovskite with aspect ratios greater than 100.

2. The ablative compound according to claim 1 wherein the perovskite is exfoliated.

3. The ablative compound according to claim 1 wherein the perovekite has a loading rate of between 30 and 40% due to the perovskite's unique ability to readily blend in an elastomeric, a resinous, and/or other materials forming the ablative compound.

4. In an ablative compound, the improvement comprising:

the use of synthetic perovskite with aspect ratios of between 100 and 700 at 15-30 angstroms;

wherein said perovskite has a loading rate of between 30 and 40% due to the perovekite's unique ability to readily blend in an elastomeric, a resinous, and/or other materials forming the ablative compound.

* * * * *